US005168478A

United States Patent [19]

Baker

[11] Patent Number: 5,168,478

[45] Date of Patent: Dec. 1, 1992

[54] TIME STANDARD ASSEMBLY WITH UPSET PROTECTION AND RECOVERY MEANS

[75] Inventor: Anthony P. Baker, Westhaven, Conn.

[73] Assignee: ITT Corporation, New York, N.Y.

[21] Appl. No.: 488,561

[22] Filed: Mar. 2, 1990

[51] Int. Cl.[5] ..... G04B 17/20

[52] U.S. Cl. ..... 368/202; 368/118; 368/286

[58] Field of Search ..... 368/202, 118, 286

[56] References Cited

U.S. PATENT DOCUMENTS 4,755,824 7/1988 Buddulph et al. ..... 174/50

*Primary Examiner*—Bernard Roskoski

*Attorney, Agent, or Firm*—Arthur L. Plevy; Patrick M. Hogan

[57] ABSTRACT

A time standard assembly for a global positioning system (GPS), such as for a space vehicle, has a natural-frequency atomic frequency standard (NAFS) which is operated at its natural resonant frequency in order to output an upset-proof natural frequency signal. The assembly includes a frequency synthesizer unit (FSU) and microprocessor data unit (MDU) which are hardened by combining them together and enclosing them in one integral unit which is shielded from the electromagnetic pulse of an upset event. Multiply redundant NAFS, FSUs, and MDUs are used to improve reliability and for maintaining units on-line and in standby. A dithered clock frequency signal is generated by the FSU according to a dither algorithm performed by the MDU, and the MDU generates encoded clock data using the dithered clock frequency signal. The MDU includes an upset recovery mechanism for resetting its registers and counters using the upset-proof natural frequency signal from the NAFS upon detecting the occurrence of an upset event.

18 Claims, 12 Drawing Sheets

NATURAL FREQUENCY SYNTHESIZER UNIT

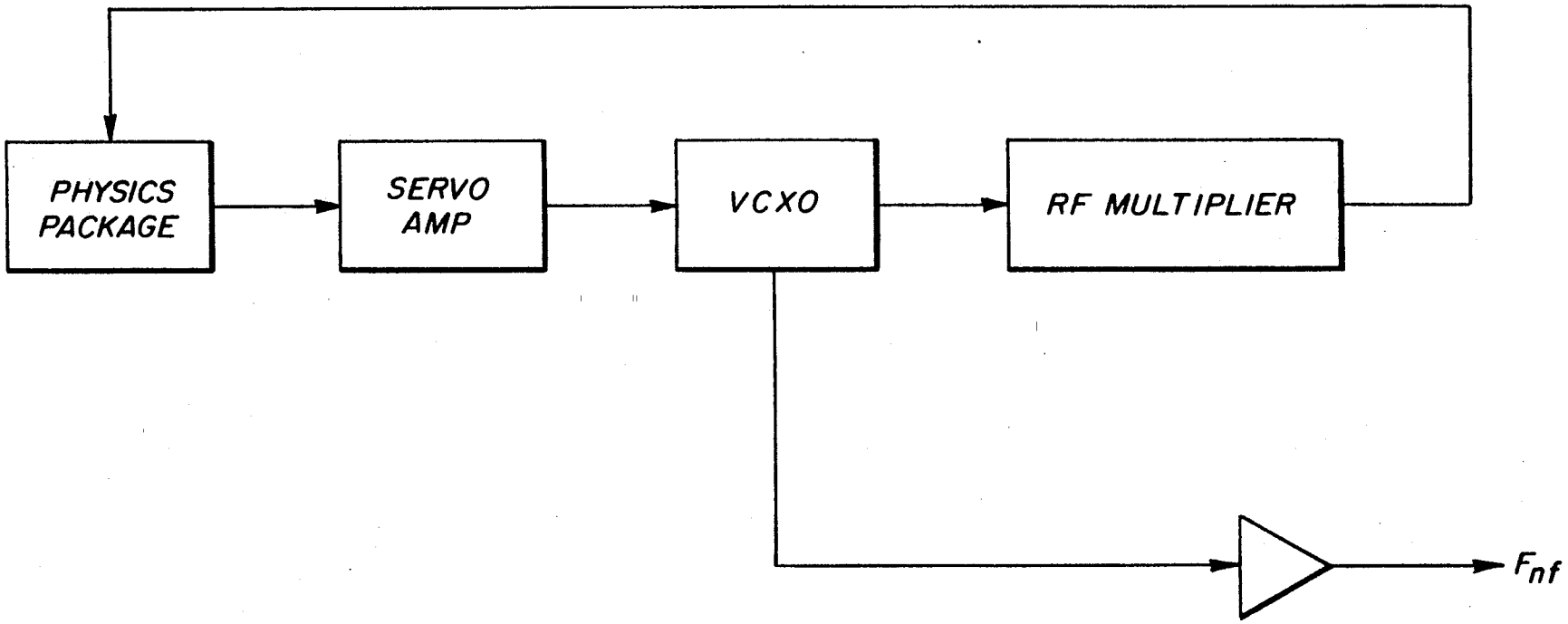
FIG-7 NATURAL FREQUENCY ATOMIC STANDARD

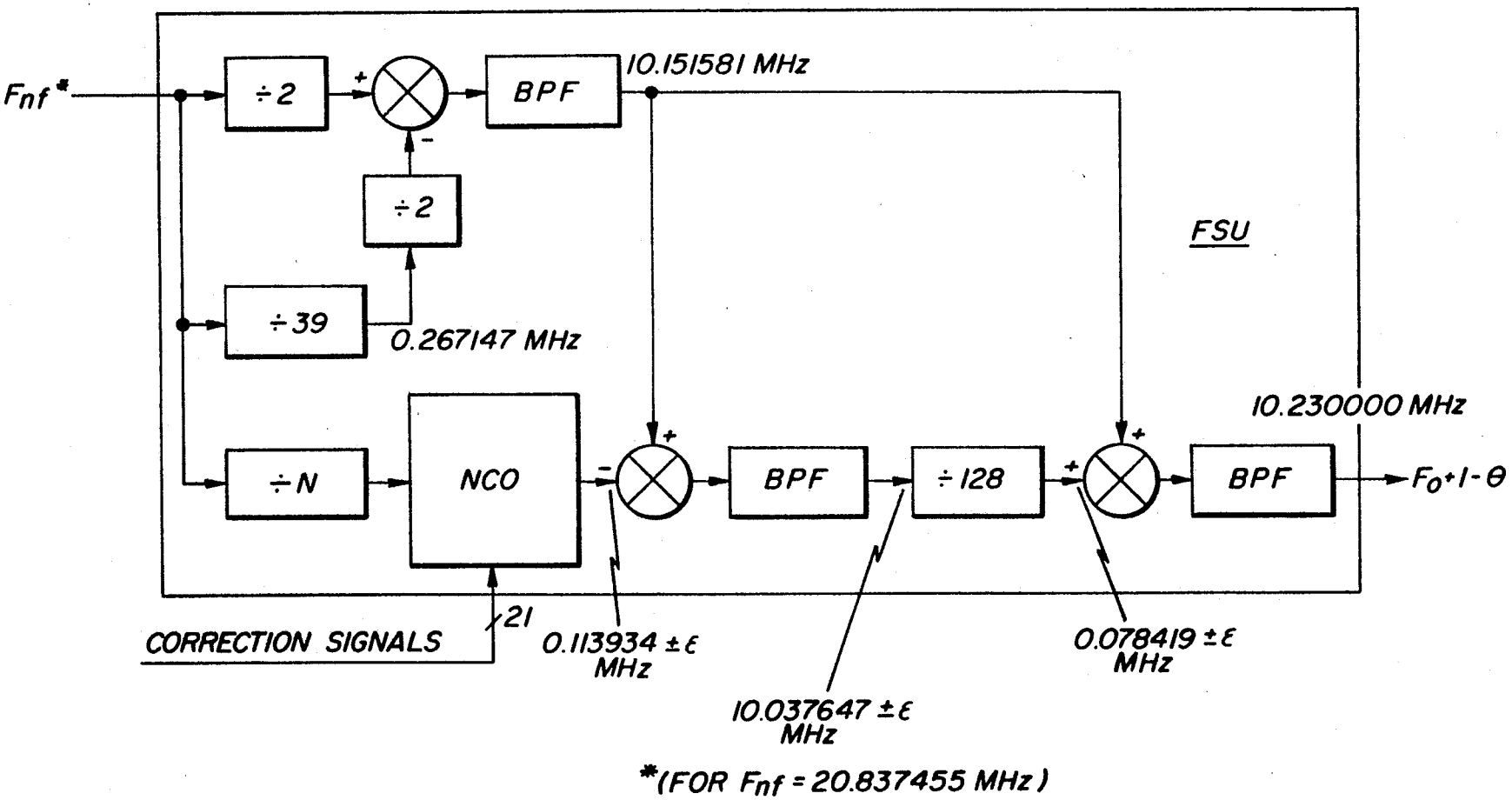
FIG-8 NATURAL FREQUENCY SYNTHESIZER UNIT

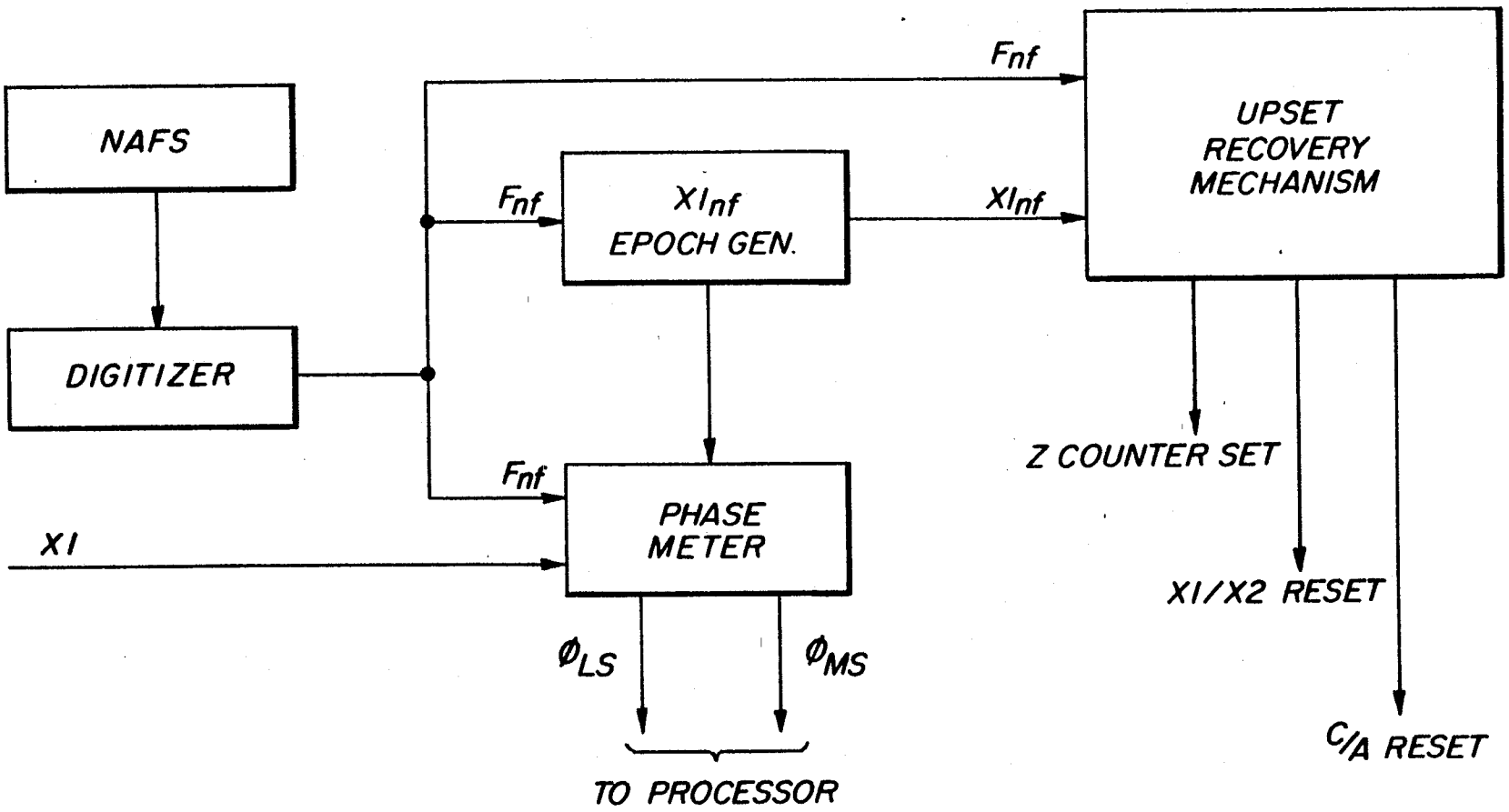
FIG-9 PORTION OF MDU

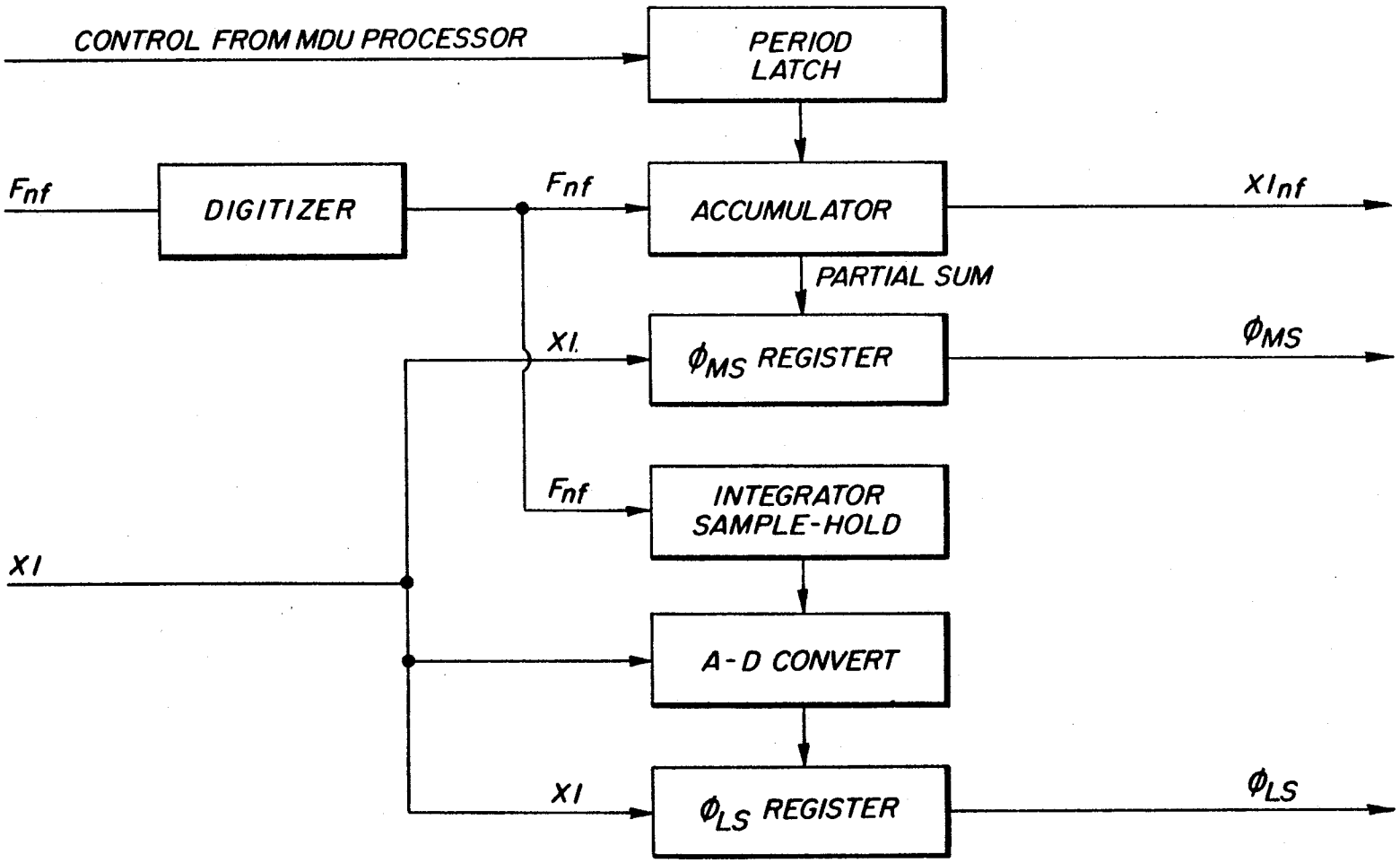
FIG-10 PHASE METER AND $XI_{nf}$ EPOCH GENERATOR

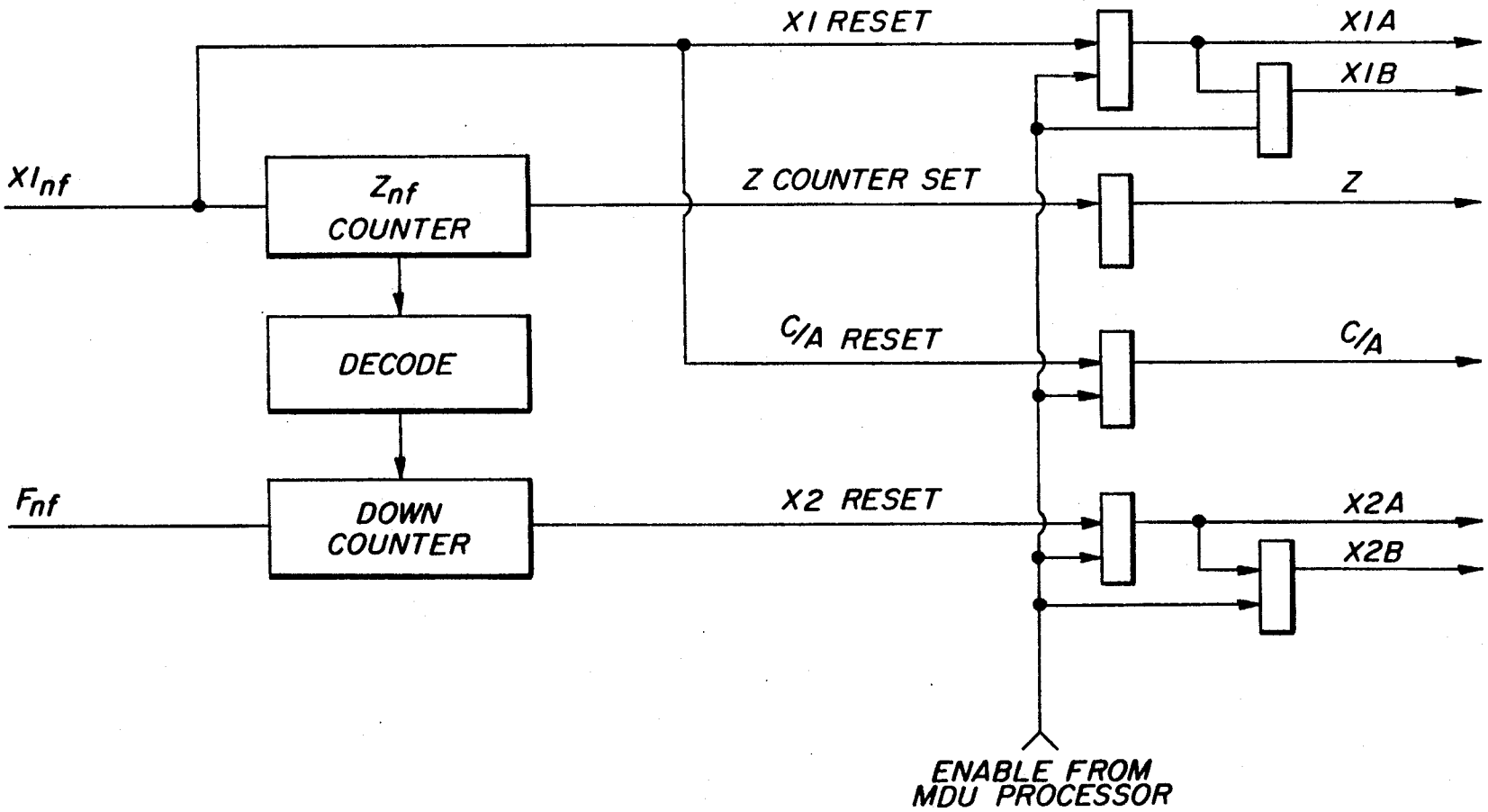
FIG-11 UPSET RECOVERY MECHANISM

FIG-12 MDU UPSET RECOVERY PROCEDURES
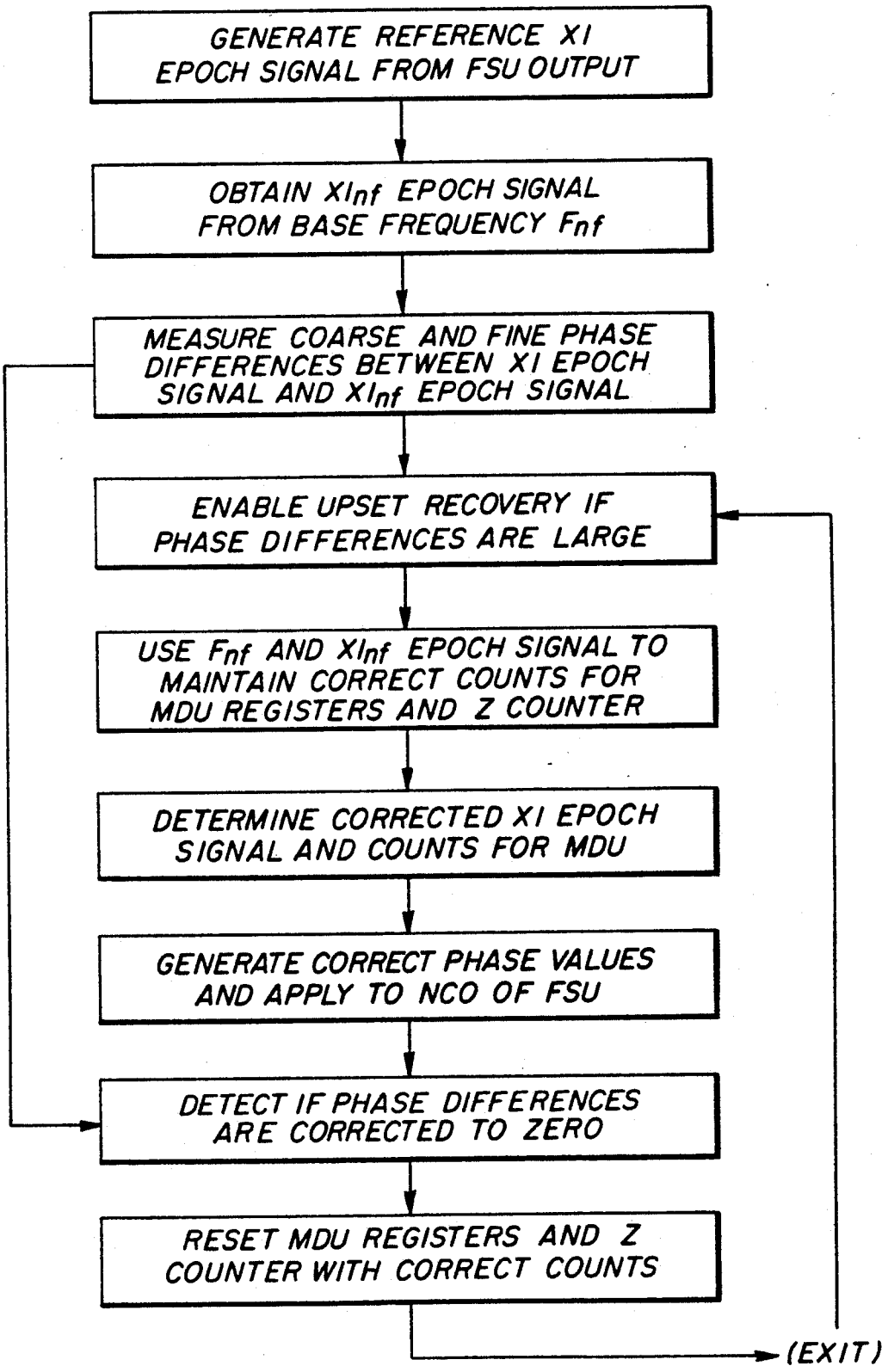

TIME STANDARD ASSEMBLY WITH UPSET PROTECTION AND RECOVERY MEANS

FIELD OF INVENTION

The present invention relates to a time standard assembly which provides the necessary clock and timing functions for a global positioning system, such as for a space vehicle, and particularly, to a time standard assembly having upset protection and recovery means for maintaining precise system performance through an upset event.

BACKGROUND OF INVENTION

It is desired that a time standard assembly for a global positioning system (GPS), such as for satellites, space vehicles, and the like, be able to withstand a high level electromagnetic disturbance, such as from a nuclear event, to operate for an extended period of time without ground control assistance, to operate within specified error limits over given periods of time, and to have a long mission life expectancy and high probability of precision performance.

An example of a time standard assembly that is conventionally used for a global positioning system (GPS) is illustrated in FIGS. 1–5. Referring to FIG. 1, an atomic frequency standard (AFS), or so-called "atomic clock", employs a physics package 10 which outputs a frequency signal based upon atomic resonance that is amplified by servo amplifier 11 and input to a voltage controlled oscillator (VCXO) 12. The VCXO provides an oscillator signal to the synthesizer section "A"which synthesizes a standard 10.23 MHz frequency signal $F_o$. A digital control section "B" responsive to ground control inputs is used to generate C-field control inputs which are applied to the physics package 10. The C-field inputs induce frequency changes in the physics package 10 which, for example, correct for relativistic effects and clock offset and drift. A control signal is also fed back to the physics package 10 in a primary loop from the VCXO through an RF multiplier 13.

In FIG. 2, the 10.23 MHz frequency signal $F_o$ output from the AFS unit is input to a frequency synthesizer unit FSU containing dividers, mixers, filters, and a numerically controlled oscillator NCO which is used to "dither" the phase of the 10.23 MHz signal within a range of +/− e. The NCO also sends measurements of the fine phase differences between the dithered and undithered 10.23 MHz signals to a processor (described below) which calculates any required phase correction values and feeds them back to the NCO of the FSU.

As shown in FIG. 3, the dithered 10.23 MHz output ($F_o$ +/− e) from the FSU is input to a microprocessor data unit MDU, which encodes the dithered frequency signals into clock code signals $XP_i$. Two sets of paired encoder registers X1A, X1B and X2A, X2B generate respective sets of clock codes X1 and X2 which are combined to generate the output encoded clock codes $XP_i$ (the P codes). The MDU generates a unit (X1) epoch signal based upon the dithered 10.23 MHz frequency signal to mark successive epochs of time tracked by the MDU. The MDU encoder registers are reset to predetermined states with each successive epoch counted. A unit clock count (Z-count) is maintained for each successive epoch. The P code generator can be made partially upset-proof by implementing the components of the MDU using CMOS SOS technology. Incorrect P codes can be generated however if spurious dithered 10.23 MHz signals are input due to an FSU upset. Improper signal edges entering the MDU registers will produce incorrect counts in these registers, thus causing improper P codes to be generated.

FIG. 4 shows the further processing by the MDU of the encoded clock codes into output encoded navigational clock data. The X1 epoch signal is used to generate a signal for resetting a data encoder with each epoch. The epoch reset signal and dithered 10.23 MHz signal are used by a XG code generator to generate codes $XG_i(t)$. The data encoder receives the epoch reset signal and the formatted P-code data. The output of the data encoder is combined with the $XG_i(t)$ code signal to produce the output C/A codes which are used as encoded navigational data for the space vehicle using the GPS time standard assembly.

FIG. 5 illustrates the phase correction processing used by the MDU of the conventional GPS time standard assembly to measure the coarse phase differences between the dithered and undithered 10.23 MHz signals between successive epochs. The MDU uses the undithered 10.23 MHz frequency signal to generate a reference epoch signal, which is compared to the X1 epoch signal by a phase meter in order to measure the coarse phase differences between the undithered and dithered 10.23 MHz frequency signals. As noted above, fine (dither) phase differences are measured at the FSU. The measured values for coarse and fine phase differences are sent to a processor in the MDU where they are compared to the expected phase difference values calculated from a dither algorithm. Phase correction commands are then sent by the processor to the NCO in the FSU if the measured phase values are incorrect. There is a limit to the magnitude of the phase error that can be corrected. If this limit is exceeded, code generation is aborted and non-standard (NS) codes are generated until corrective action is taken from ground control.

The circuitry of both the "A" and "B" sections of the AFS of the described conventional GPS is susceptible to large scale upsets, for example, those induced by nuclear events. Shielding the circuits will reduce the likelihood of an upset, but not to a level that is satisfactory. Introducing high "Q"circuits at the output of the synthesizer of section "A" to bridge upsets might not prevent phase discontinuities. Upsets to the circuitry of section "B", which controls the strength of the C-field of the physics package, can cause large frequency changes. This arrangement also requires considerable circuitry which reduces reliability. Clock and timing measurements may be recovered after an upset (i.e., no latch-up) but may not be recovered at the correct phase or at the correct epoch or Z count.

The conventional GPS FSU is also susceptible to upsets because it uses frequency synthesizers and other non-linear devices. Such non-linear devices can recover from an upset, but the 10.23 MHz signal may experience a phase jump and, during the recovery process, noise edges may be generated that will result in incorrect code generation in the MDU. Upsets will also cause improper dither and erroneous phase measurements by the numerically controlled oscillator NCO.

The P and C/A code generators of the MDU can be made partially upset-proof through the use of CMOS SOS technology. However, they can generate incorrect codes due to an FSU upset. As can be seen from FIG. 3, spurious inputs from the dithered 10.23 MHz signal can cause incorrect generation of the P codes. Improper edges entering the MDU registers will produce incorrect counts in these registers, thus causing improper P codes to be generated. Provision must thus be made to adjust the state of these registers. The C/A code generator illustrated in FIG. 4 can be similarly affected.

As to the phase detection logic in FIG. 5, upsets to the FSU of the GPS equipment will cause large phase differences which may exceed the limit of that which can be corrected. Subsequent generation of NS codes will be instituted, thus making the space vehicle useless for navigation, and thereby requiring that the problem be fixed with the help of ground control. Even if the processor is upset proof itself, it can "crash" either as a result of an upset to other circuits or as a result of errors caused by other factors. When processor "crashes" occur, the processor enters into a reset routine which attempts to restore operation. Until operation is restored, NS codes are generated. Since the phase differences are measured against the undithered output frequency signal from the AFS, it is also crucial for phase measurement that the AFS be upset proof, otherwise an upset might not be detected.

SUMMARY OF INVENTION

In order to overcome the problems of the conventional time standard assembly for a global positioning system, it is a principal object of the invention to provide a time standard assembly which is much less susceptible to upset, and which has provision for recovery from an upset without loss of integrity of its clock and timing functions and without the need for ground control assistance. It is a further object that the time standard assembly have an upset recovery mechanism which has back-up redundancy, is self-monitoring, and can tolerate an upset by providing for forced recovery of its own circuits.

In accordance with the invention, a time standard assembly for a global positioning system (GPS) has an improved structure, layout design, and provision for its own upset recovery. The AFS, FSU, and MDU units are hardened as much as possible by shielding and by the use of CMOS SOS technology. The AFS unit is hardened by removing the conventional 10.23 MHz synthesizer and C-field control unit, and by instead operating the AFS at its natural resonant frequency (NRF) and with a fixed, minimum C-field. The FSU and MDU units are hardened by combining them together and enclosing them in one shielded part to reduce the effects of an electromagnetic pulse surge on the interconnections between the units, and to simplify the radiation shielding. The dithered 10.23 MHz frequency signal is synthesized in the hardened FSU using as the base frequency an upset proof sub-harmonic $F_{nf}$ of the NRF standard from the AFS. The AFS frequency output is monitored and corrected for errors caused by relativistic effects and frequency offset and drift by using a numerically controlled oscillator (NCO) located within the FSU.

The reliability of the GPS is also improved by using multiply redundant AFS, FSU, and MDU units, and cross-strapping the units so that any one of them can be switched over into on-line operation while the other(s) are held in standby. In a preferred configuration, two AFS units are kept on-line, with one or more in standby, and the cross-strapping connects one of the AFS units with an on-line FSU unit, and the other with an on-line MDU unit. The cross-strapping is designed to interface between an array of NAFS units and an array of the combined FSU/MDU units, and between the latter and a subsequent output stage. The array of FSU/MDU units can thus be shielded within one integrated section and made further upset-proof by using CMOS SOS technology.

In addition to reconfiguring and hardening the components of the time standard assembly, upset recovery procedures using CMOS SOS logic are employed by the MDU of the improved GPS to force its own recovery before vehicle navigation is compromised. The procedures include: (a) developing an upset-proof $X1_{nf}$ epoch signal from the $F_{nf}$ which is synchronized to the correct GPS time; (b) measuring coarse and fine phase differences between the $X1_{nf}$ epoch signal and the unit X1 epoch signal generated in the MDU; (c) detecting whether the phase difference measurements indicate an upset event and enabling the institution of upset recovery measures upon such detection; (d) using the $F_{nf}$ and the $X1_{nf}$ signals to maintain correct counts for the MDU registers and Z counter during an upset; (e) determining (in hardware) the correct X1 epoch signal and register counts at which to reinitialize the MDU registers and data encoder; and (f) subsequent to an upset, setting the correct Z count into the Z counter and reinitializing the MDU registers and data encoder. NS codes are thus generated only until this process is completed.

BRIEF DESCRIPTION OF DRAWINGS

The above objects and further features and advantages of the invention are described in detail below in conjunction with the drawings, of which:

FIG. 7 is a diagram of a natural-frequency atomic frequency standard (NAFS) in accordance with the invention;

FIG. 8 is a diagram of an FSU for the system of FIG. 6;

FIG. 9 is a diagram of an MDU for the system of FIG. 6 including an upset recovery mechanism;

FIG. 10 is a logic diagram for generating phase difference measurements for the system of FIG. 6;

FIG. 11 is a diagram of upset recovery circuitry for the system of FIG. 6; and

FIG. 12 is a flow diagram of the upset recovery procedure in accordance with the invention.

DETAILED DESCRIPTION OF INVENTION

Figure 6:
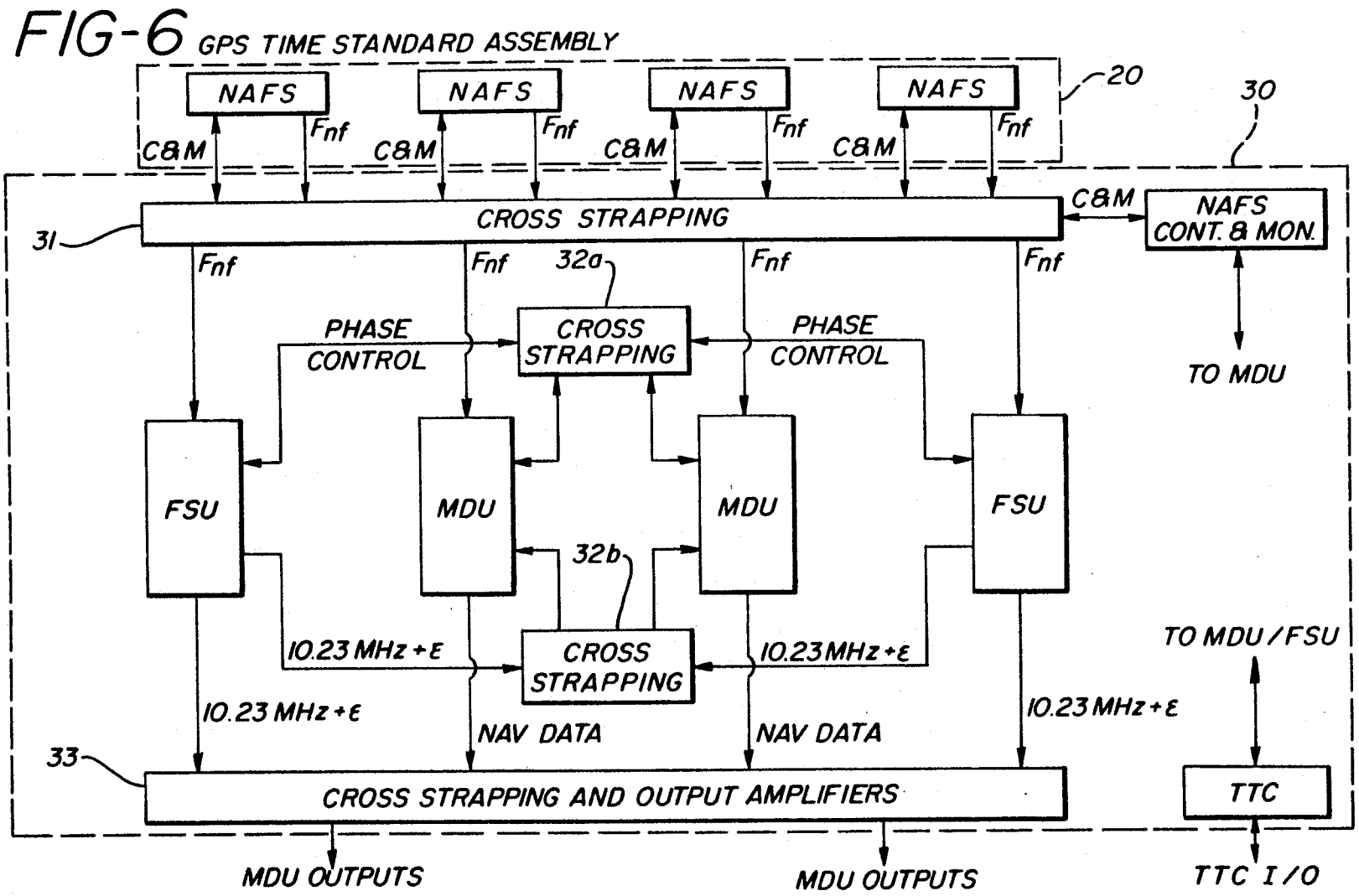
FIG. 6 is an overall diagram of a time standard assembly in accordance with the invention having provision for upset protection and recovery.

Referring to FIG. 6, an improved GPS time standard assembly has a first section 20 of multiply redundant, stable atomic frequency standards (NAFS) each of which is operated at its natural resonant frequency (NRF) and outputs a sub-harmonic frequency signal $F_{nf}$ of the NRF. The outputs of the NAFS section 20 are input to a second section 30 containing a pair of FSU units and a pair of MDU units integrated together within one shielded block. Integration reduces the number of power supplies used, removes the interface circuitry previously required between the FSU and MDU, reduces weight, improves the effectiveness of the radiation shielding, and lessens overall sensitivity to an electromagnetic pulse event.

The multiple NAFS units provide the base frequency input $F_{nf}$ to the FSU and MDU units through cross-strapping 31. The cross-strapping permits any NAFS to be connected to any FSU and any MDU. Additionally, cross-strapping 32*a*, 32*b* permits any FSU to be connected to any MDU. Cross-strapping 33 interfaces the outputs of the FSU and MDU units with an output stage from the FSU/MDU section 30. Control and monitoring (C&M) signals are exchanged between the MDU and the operational NAFS through cross-strapping 31.

Preferably, two NAFS are kept on-line concurrently, one drives one of the redundant FSUs, and the other drives one of the redundant MDUs. The MDU is synchronized to the FSU which is, in turn, synchronized to GPS time. This arrangement permits switching over from dual to single NAFS operation if necessary. It also permits the replacement of an operational NAFS with a cold standby NAFS after it has been powered-on and stabilized, thereby improving system integrity.

Each FSU unit synthesizes the standard 10.23 MHz frequency signal and dithers it in response to commands from the MDU processor. The dithered 10.23 MHz signal is sent to the MDU and other units of the GPS. The MDU measures the phase dither of the 10.23 MHz signal to ensure that it is correct and generates the P codes, C/A codes, Z count, and output navigation data all synchronized to 10.23 MHz. It further provides for recovery from an upset by generating a set of upset-proof timing parameters (described further below) which can be used to reset the critical timing and code-generating registers to correct states after an upset event.

Figure 1:
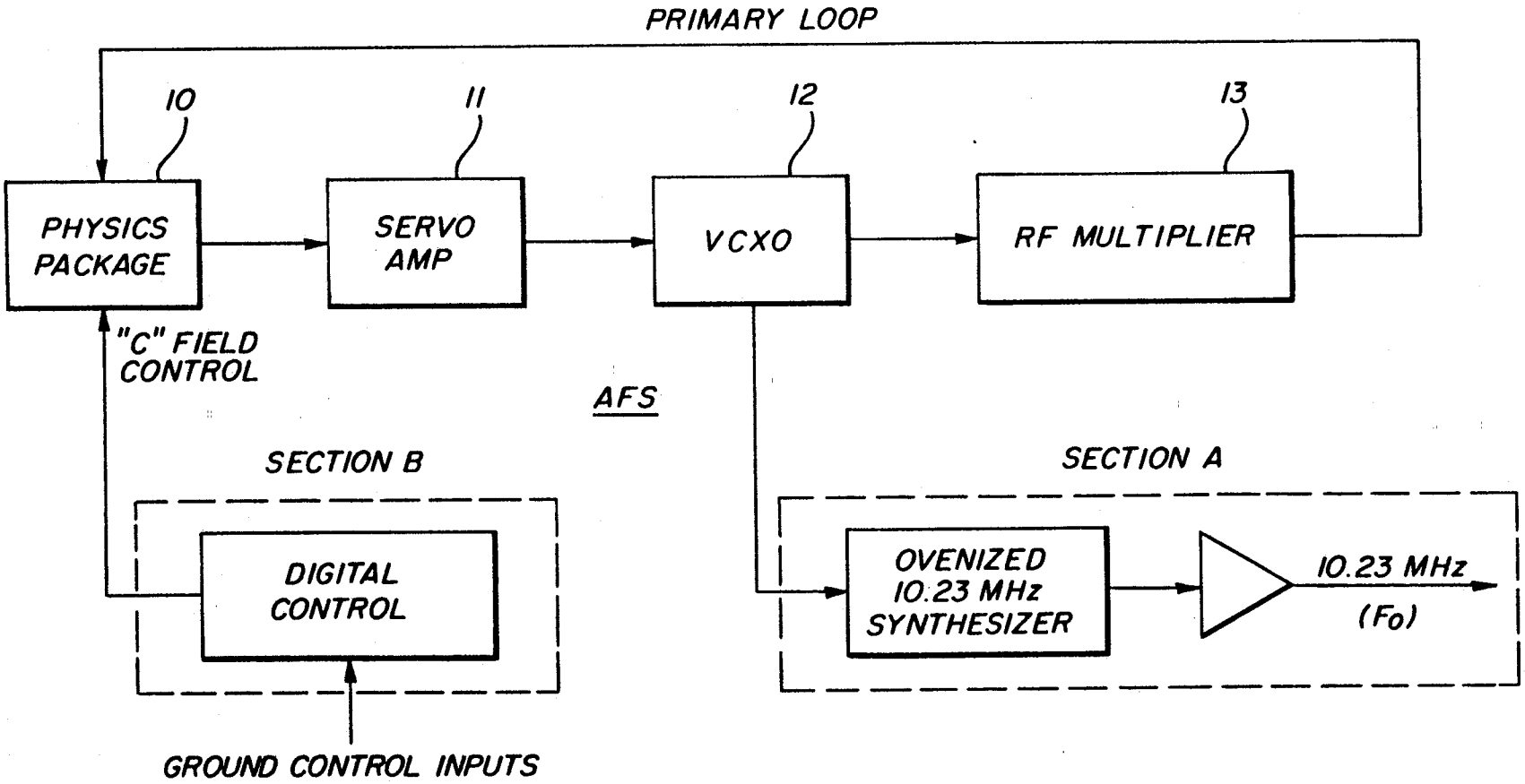
FIG-1 PRIOR ART
FIG. 1 is a diagram of an atomic frequency standard (AFS) for providing an output frequency signal as used in a conventional global positioning system (GPS)
Figure 2:
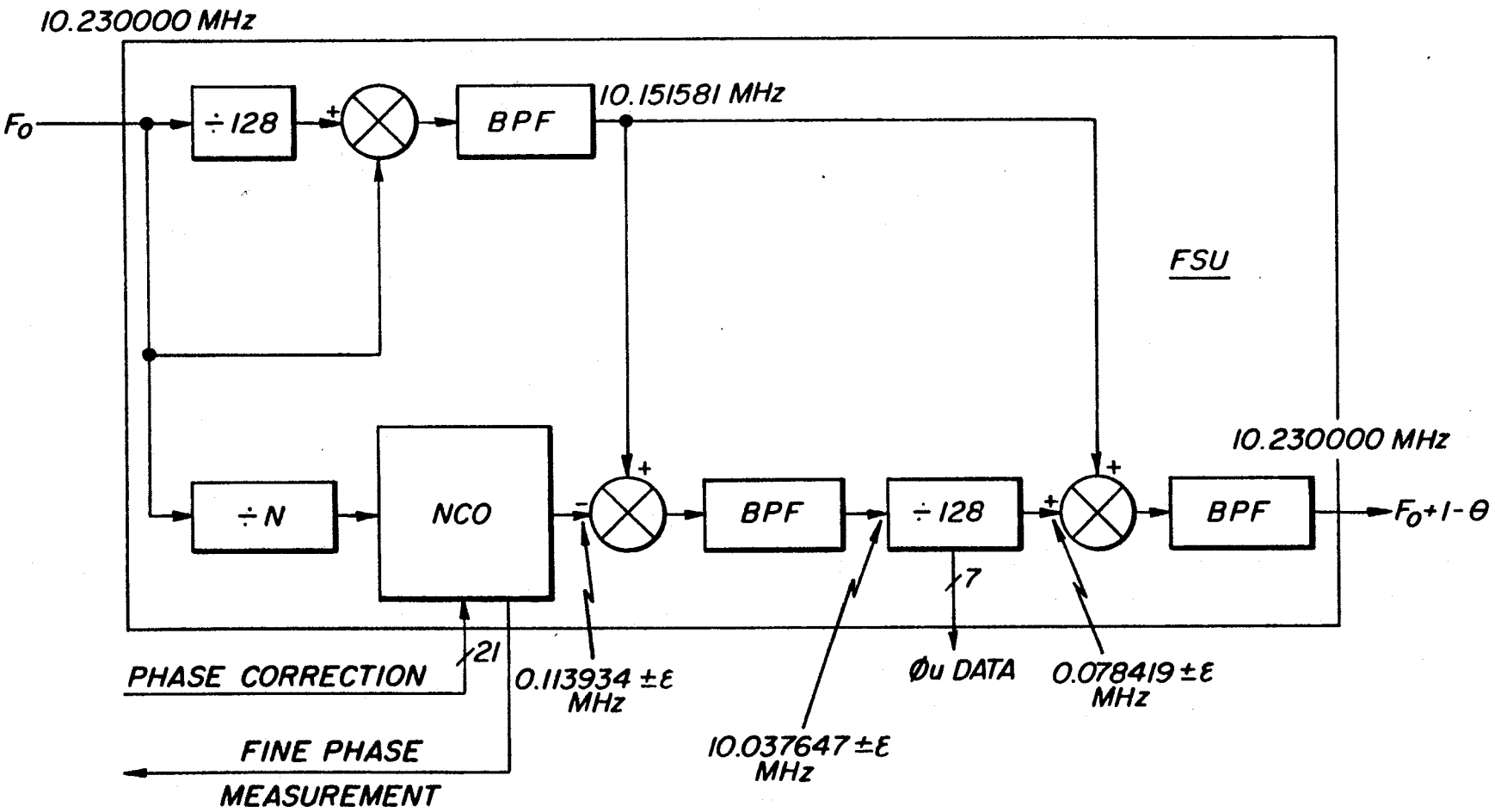
FIG-2 PRIOR ART
FIG. 2 is a diagram of a frequency synthesizer unit (FSU) of a conventional GPS for generating a dithered frequency signal.
Figure 3:
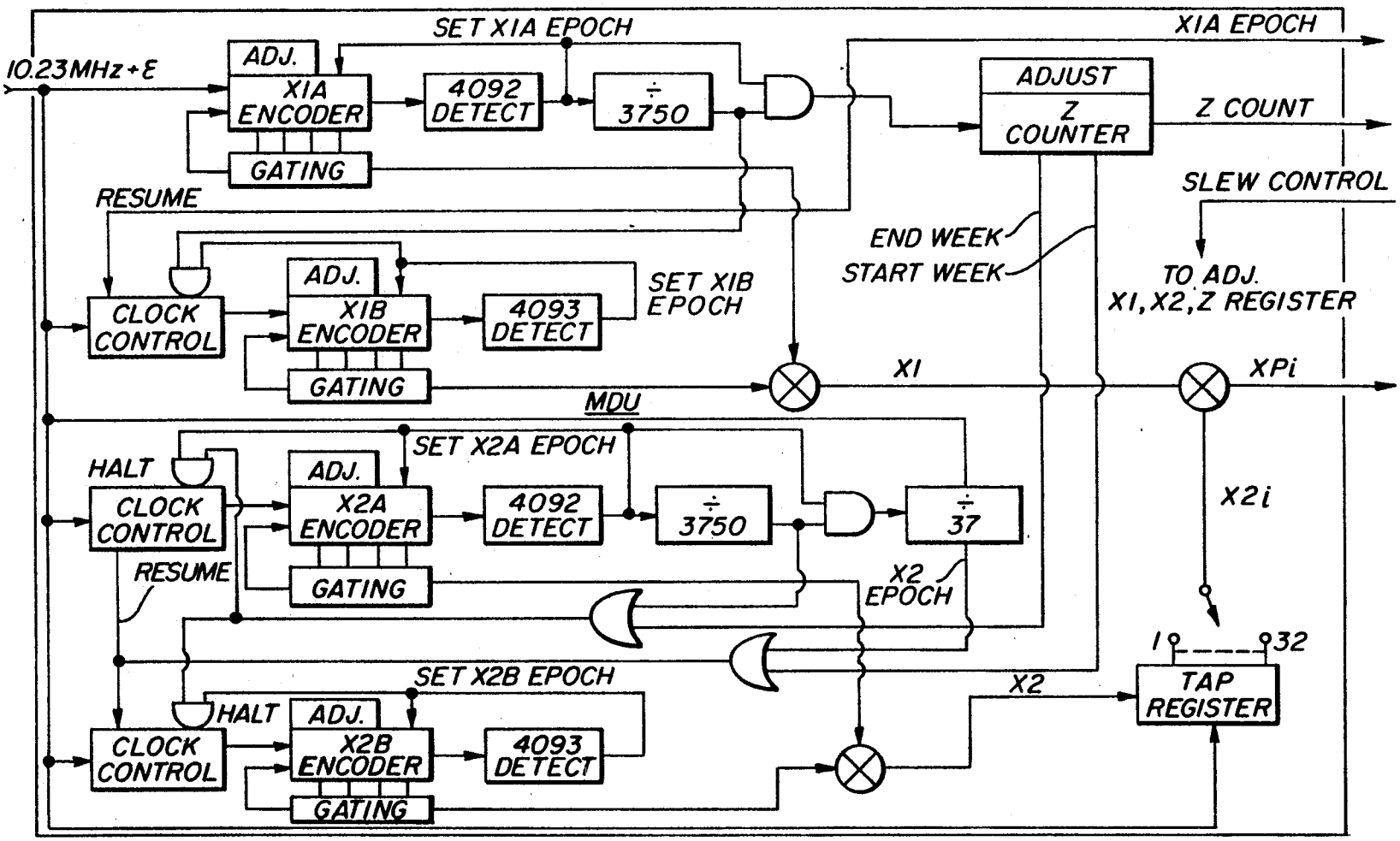
FIG-3 PRIOR ART
FIG. 3 is a diagram of a microprocessor data unit (MDU) of a conventional GPS for generating clock data codes based upon the dithered frequency signal.
Figure 4:
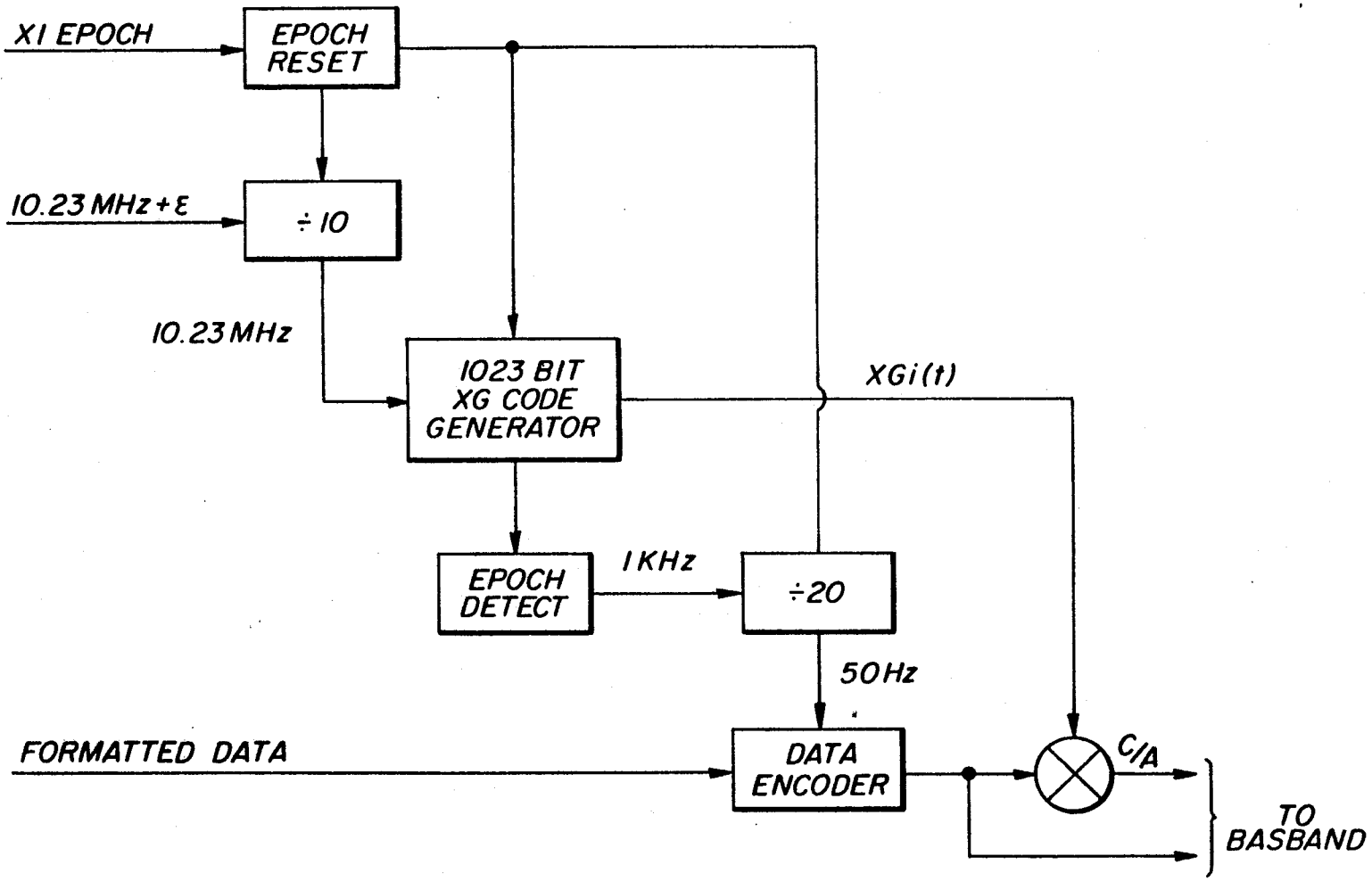
FIG-4 PRIOR ART
FIG. 4 is a diagram of a further processing step of the MDU for generating output C/A navigational data codes.
Figure 5:
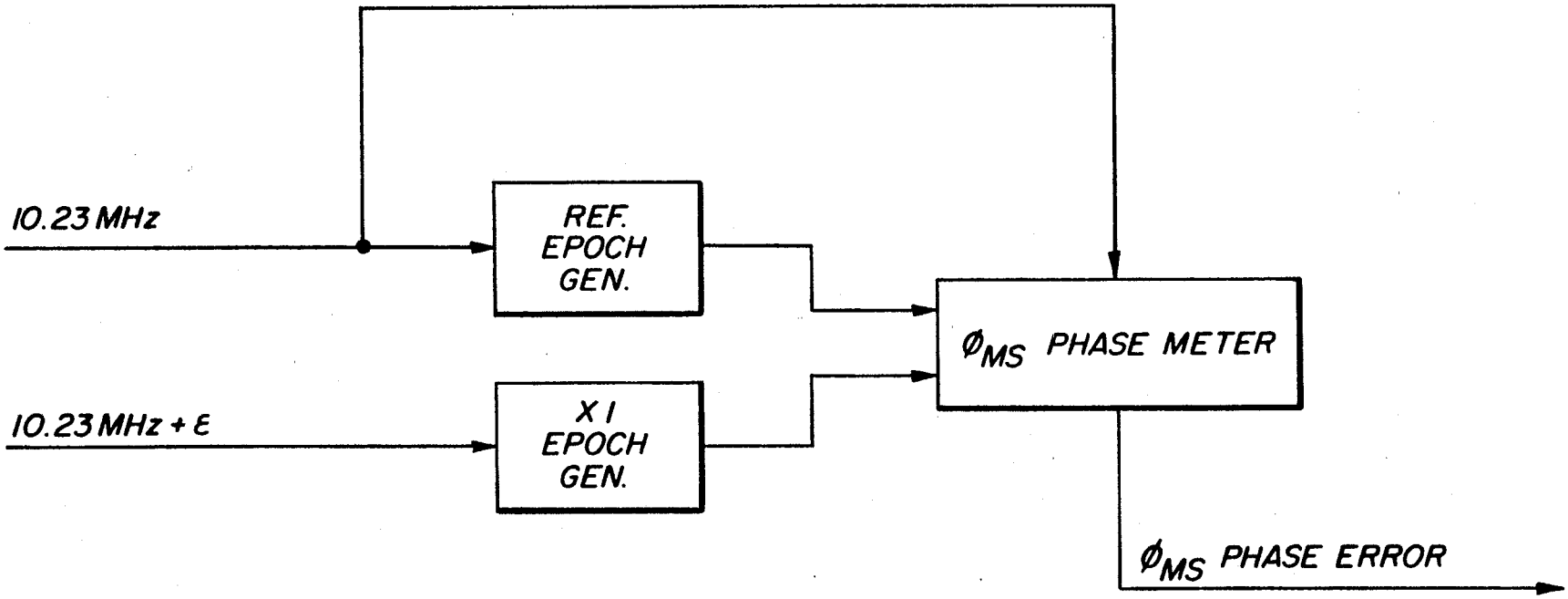
FIG-5 PRIOR ART
FIG. 5 is a diagram of a further processing step for generating phase difference measurements for phase correction of the FSU.

The NAFS units may be rubidium, cesium, or hydrogen maser atomic frequency standards. The performance of the hydrogen maser is exceptional, although its cost is presently high. As shown in FIG. 7, an example of a rubidium NAFS design includes the standard physics package, servo amp, VCXO, and feedback RF multiplier. As the NAFS is operated at its natural resonant frequency, the frequency synthesizer Section "A" and the C-field control Section "B" of the conventional AFS (see FIG. 1) are eliminated. This improvement reduces the possibility of an upset induced by a nuclear event, improves reliability, and reduces power consumption and weight.

Referring to FIG. 8, the FSU uses the $F_{nf}$ base frequency output of the NAFS to synthesize a dithered 10.23 MHz frequency signal using a combination of dividers, mixers, and filters selected according to the expected $F_{nf}$ frequency (20.837455 MHz in the rubidium maser example). A numerically controlled oscillator (NCO) is used to dither the 10.23 MHz signal. Correction signals are provided to the NCO of the FSU from the MDU processor to correct for relativistic effects and clock offset and drift. In contrast, the conventional GPS performs these corrections by adjusting the C-field of the AFS physics package. The MDU processor may provide a multi-bit word in which a fixed-bit field is used for physics correction and a variable-bit field is used for dither and phase correction of the 10.23 MHz signal. Since relativistic and clock corrections are expected to remain constant, they could be latched into the NCO upon initialization. Thereafter, the MDU processor would provide only dither and phase correction commands.

In the invention, the FSU no longer provides fine phase measurements. These are now performed in the MDU by the same phase meter that measures the coarse phase difference. Since it is at the MDU that phase differences cause problems, measuring them upstream at the FSU raises undetected phase error possibilities caused by intervening operations. Consequently, measurement at the MDU improves system integrity. The FSU is shielded, but it is not necessary to make it completely impervious to upset events, since it will recover from an upset (i.e. no latch-up) although perhaps a large phase difference or noise spikes may be induced in its 10.23 MHz output. These are corrected by the phase error detection and upset recovery procedures of the MDU described further below.

In FIGS. 9–11, an improved MDU unit is illustrated having provision for phase error detection and initializing its own upset recovery procedures within the unit. FIG. 12 illustrates the upset recovery sequence. Referring to FIG. 9, the MDU receives the $F_{nf}$ signal from the NAFS through cross-strapping, and supplies a digitized $F_{nf}$ signal to the $X1_{nf}$ epoch generator, a phase meter, and an upset recovery section. The phase meter provides the MDU processor with coarse and fine phase values of the phase dither so that they can be checked against the expected values computed by the dither algorithm. The MDU commands the NCO of the FSU to correct the frequency if the measured values are incorrect.

Differences between the expected and measured phase values in excess of a maximum tolerable amount are assumed to be caused by an upset. When it detects an upset, the MDU processor sends NS codes to the user and enables the upset recovery logic which resets or re-initializes the appropriate MDU registers and Z count register. The MDU processor calculates the required phase values using the dither algorithm and re-establishes the correct dither phase by issuing frequency change commands to the NCO in the FSU. As soon as the phase error has been reduced to zero, the NS codes are removed, and the MDU operation returns to normal. NS codes are thus generated only until this process is completed. The upset recovery logic can also be used periodically to reset and re-initialize the MDU registers in order to prevent error build-up.

More particularly, the upset recovery mechanism in FIG. 9 continuously calculates the precise time when a reset of the Z counter and re-initialization of the X1, X2 and C/A registers and the data encoder can be executed without interfering with the GPS operation. The mechanism takes no action until it is enabled. This approach is based upon the fact that during normal operation the X1 registers are reset to a known value at each X1 epoch and that the X2 registers are reset at a selected value $Z_o$ programmed into the GPS.

Referring to the recovery sequence in FIG. 12, the $X1_{nf}$ epoch signal generated from the base frequency $F_{nf}$ is deemed upset-proof since $F_{nf}$ is the natural frequency signal output of the NAFS which has been designed so as not to be affected by the electromagnetic pulse of an upset event. The phase meter in FIG. 9 compares the phase of the upset-proof $X1_{nf}$ epoch signal to the X1 epoch signal currently being generated in the MDU based upon the dithered 10.23 MHz frequency signal provided from the FSU. If the phase difference is large, an upset event is assumed, and the upset recovery mechanism is enabled.

Upon enabling the upset recovery mechanism, the upset-proof $F_{nf}$ and the $X1_{nf}$ signals are used to maintain correct counts for the MDU registers and Z counter during the upset event. The correct X1 epoch signal and X1, X2, and C/A register and Z counter counts are determined. At the same time, the MDU processor determines the correct phase values for the dithered 10.23 MHz signal of the FSU, and supplies the phase correction signals to the NCO. When the upset event has ended, the NCO of the FSU functions normally to output the dithered 10.23 MHz signal with the correct phase. The phase meter detects the correction of the phase difference to zero indicating that the upset event has ended. The correct MDU register and Z counts, based upon the upset-proof $F_{nf}$ and $X1_{nf}$ epoch signal, are then used to reset the Z counter and MDU registers and data encoder.

In FIG. 10, one technique for implementing the $X1_{nf}$ epoch generator and phase meter is shown. The $F_{nf}$ signal is used to drive an accumulator. The accumulator adds the period of $F_{nf}$ to itself until the accumulator overflows within a given reference epoch period, e.g. every 1.5 seconds. The accumulator outputs an epoch pulse $X1_{nf}$ every 1.5 seconds and the value (overflow or partial sum) of the accumulator at every input pulse from the period latch in response to a control signal from the MDU processor.

The value from the accumulator is fed to the MS phase register which is strobed by the X1 epoch signal generated by the MDU's P-code generator from the dithered 10.23 MHz signal synthesized by the FSU. The value in the MS phase register when it is strobed represents the most significant bits of the phase difference between the $X1_{nf}$ and the dithered 10.23 MHz. The value in this register therefore cannot be less than the period of $F_{nf}$.

The phase of the dither is to be measured within a given accuracy at 10.23 MHz, e.g. to within 0.5 microhertz. The value measured by the MS phase measurement does not provide this accuracy. Interpolation between successive $F_{nf}$ pulses is required at the time the MS phase register is strobed. This can be accomplished, for example, by feeding $F_{nf}$ to an integrator and sample-and-hold circuit whose output is converted to a digital value by an A/D converter. The output of the A/D converter is sent to an LS phase register which is strobed by the MDU X1 epoch signal. The value in the LS phase register will then represent the least significant bits of the phase difference between the natural-frequency epoch signal $X1_{nf}$ and the dithered 10.23 MHz frequency signal from the FSU.

FIG. 11 illustrates an example of the upset recovery mechanism for resetting the MDU registers and Z counter to the correct values after an upset. An upset-proof $Z_{nf}$ count is maintained in a counter by counting the given $X1_{nf}$ epochs generated by the accumulator (e.g., the 1.5 second epochs). During normal operation the Z count is equal to the $Z_{nf}$ count. The occurrence of an upset is detected by measuring large phase errors or by a mismatch between the $Z_{nf}$ count and the Z count. At the next epoch after an upset, the $Z_{nf}$ count is jamset into the Z counter register and the X1 registers are reset. The $Z_{nf}$ count is used to set a down-counter value equal to $Z_o$. When the counter equals zero, pulses are generated to reset the X2 registers.

The specific embodiments of the invention described herein are intended to be illustrative only, and many other variations and modifications may be made thereto in accordance with the principles of the invention. All such embodiments and variations and modifications thereof are considered to be within the scope of the invention, as defined in the following claims.

I claim:

1. A time standard assembly comprising:

(a) a natural-frequency atomic frequency standard (NAFS) which is operated at its natural resonant frequency (NRF) and provides a natural frequency signal output based on said NRF;

(b) a pair of frequency synthesizer units (FSUs) and a pair of microprocessor data units (MDUs) which are connected by cross-strapping to the output of said NAFS and interconnected by cross-strapping to each other, each of said FSUs being operable to receive the natural frequency signal output of said NAFS and to generate a dithered clock frequency signal based thereon, and each of said MDUs being operable to receive the natural frequency signal output of said NAFS and the dithered clock frequency signal of said FSUs and to generate encoded navigational clock data based thereon; and cross-strapping means for connecting any one of said FSUs that is operated on-line and any one of said MDUs that is operated on-line with said NAFS, and for maintaining the other of said pair of FSUs and the other of said pair of MDUs in stand-by for back-up operation.

2. The time standard assembly according to claim 1, having multiply redundant NAFS, wherein two NAFS are operated on-line, the output of one NAFS is connected to the one of said FSUs operated on-line, the output of the other NAFS is connected to the one of said MDUs operated on-line, and the remaining NAFS are held in standby.

3. The time standard assembly according to claim 1, wherein said pair of FSUs and said pair of MDUs are integrated together and enclosed in one shielded block.

4. The time standard assembly according to claim 1, wherein said NAFS is an atomic clock having a physics package selected from the group comprising cesium, rubidium, and hydrogen masers.

5. The time standard assembly according to claim 1, wherein said natural frequency signal output is a subharmonic $F_{nf}$ of said NRF.

6. A time standard assembly having means for protecting against and recovering from an electromagnetic pulse upset event which upset event produces a high level of electromagnetic interference such as generated by a nuclear blast which interference substantially and adversely upsets the time standard frequency stability, comprising:

(a) a natural-frequency atomic frequency standard (NAFS) which is operated at its natural resonant frequency (NRF) and provides a natural frequency signal output ($F_{nf}$) based on said NRF which is upset-proof;

(b) at least one frequency synthesizer unit (FSU) and at least one microprocessor data unit (MDU) which are integrated together and enclosed in one shielded block, said integrated FSU and MDU being connection operatively to each other, wherein said FSU is operable to receive the upset-proof natural frequency signal $F_{nf}$ output of said NAFS and to generate a dithered clock frequency signal based thereon, and said MDU is operable to receive the $F_{nf}$ output of said NAFS and the dithered clock frequency signal of said FSU and to generate encoded clock data based thereon.

7. The time standard assembly according to claim 6, wherein said at least one FSU includes a pair of FSUs and said at least one MDU includes a pair of MDUs, and further comprising cross-strapping means for connecting any one of said FSUs that is operated on-line and any one of said MDUs that is operated on-line with said NAFS, and for maintaining the other of said pair of FSUs and the other of said pair of MDUs in stand-by for back-up operation.

8. The time standard assembly according to claim 6, having multiply redundant NAFS, wherein two NAFS are operated on-line, the output of one NAFS is connected to the one of said FSUs operated on-line, the output of the other NAFS is connected to the one of said MDUs operated on-line, and the remaining NAFS are held in standby.

9. The time standard assembly according to claim 6, wherein said FSU includes a numerically controlled oscillator (NCO) for producing a dithered standard clock frequency signal, and wherein said MDU includes a processor for generating phase dither control signals using a dither algorithm, said NCO of said FSU being operable in response to said phase dither signals provided from said MDU processor.

10. The time standard assembly according to claim 9, wherein said NAFS includes a physics package operable with a fixed C-field to generate its natural resonant frequency signal, and wherein said NCO of said FSU receives correction signals from said MDU processor to make any required physics corrections to the dithered standard clock frequency signal.

11. The time standard assembly according to claim 9, wherein said MDU includes a phase meter for measuring phase differences between the natural frequency signal $F_{nf}$ output of said NAFS and the dithered standard clock frequency signal of said FSU and supplying measured phase difference values to said MDU processor for comparison to expected phase difference values according to said dither algorithm, said MDU processor thereupon supplying phase dither control signals to said NCO of said FSU based upon the comparison of said measured and expected phase difference values.

12. The time standard assembly according to claim 11, wherein said MDU further includes an upset recovery mechanism for initiating its own recovery after an upset event, said MDU processor being operable to detect an upset event upon determining a high level of difference between said measured and expected phase difference values and to enable said upset recovery mechanism to institute upset recovery procedures upon such detection of the upset event.

13. The time standard assembly according to claim 12, wherein said MDU includes a unit (X1) epoch signal generator for generating epoch signals delineating successive epochs of time measured using the dithered standard clock frequency signal, a code generator including a plurality of encoder registers for generating the encoded navigational clock data from said dithered standard clock frequency signal, and a Z-counter for maintaining a clock count in each successive epoch, and wherein said MDU further includes a natural-frequency ($X1_{nf}$) epoch signal generator for generating epoch signals delineating successive epochs of time measured using the natural frequency signal $F_{nf}$ from said NAFS, said phase meter being operated to measure the phase difference values between said unit X1 epoch signal and said natural-frequency $X1_{nf}$ epoch signal, and said MDU processor being operated to detect an upset event indicated by a high level of difference between the measured and expected phase difference values.

14. The time standard assembly according to claim 13, wherein said upset recovery mechanism includes a $Z_{nf}$ counter for maintaining a natural-frequency $Z_{nf}$ count for successive epochs based upon the upset-proof $X1_{nf}$ epoch signal, and the upset-proof $X1_{nf}$ epoch signal and $Z_{nf}$ count are used to reset the registers of the MDU code generator and the Z counter subsequent to the upset event.

15. A method of resetting a time standard assembly upon the occurrence of an electromagnetic pulse upset event which upset event is defined as an event which produces high levels of electromagnetic interference such as that generated during a nuclear blast, said time standard assembly being of the type having an atomic frequency standard for providing a standard clock frequency signal, a frequency synthesizer unit (FSU) for generating a dithered clock frequency signal based upon the standard clock frequency signal, and a microprocessor data unit (MDU) for generating encoded clock data based upon the dithered clock frequency signal, wherein said MDU includes a code generator including a plurality of encoder registers for generating the encoded clock data from said dithered standard clock frequency signal, and a Z-counter for maintaining a clock count in each successive epoch, comprising the steps of:

(a) employing a natural-frequency atomic frequency standard (NAFS) which is operated at its natural resonant frequency (NRF) and provides a natural frequency signal output ($F_{nf}$) based on said NRF which is upset-proof;

(b) developing an upset-proof $X1_{nf}$ epoch signal from the $F_{nf}$ of said NAFS;

(c) detecting an upset event and enabling the institution of the following upset recovery steps;

(d) using the $F_{nf}$ and the $X1_{nf}$ signals to maintain correct counts for the MDU registers and Z counter during the upset event; and (e) detecting the end of the upset event, and setting the correct Z count into the MDU Z-counter and reinitializing the MDU registers and data encoder based upon the correct counts maintained.

16. The method of resetting a time standard assembly according to claim 15, wherein said MDU includes a unit X1 epoch signal generator for generating epoch signals delineating successive epochs of time measured using the dithered clock frequency signal, and said step of detecting an upset event includes the substeps of:

(1) measuring the phase differences values between the upset-proof $X1_{nf}$ epoch signal and the unit X1 epoch signal generated in the MDU;

(2) comparing the measured phase difference values to the expected phase difference values based upon a dither algorithm used by the MDU for controlling the FSU to generate the dithered clock frequency signal; and (3) detecting whether the difference between the measured and expected phase difference values is of a high level indicating an upset event, and thereupon enabling institution of said upset recovery steps.

17. The method of resetting a time standard assembly according to claim 16, wherein the step of detecting the end of the upset event includes the substeps of:

(1) operating the MDU to provide phase control signals using the dither algorithm for controlling the FSU to generate the dithered clock frequency signal based thereon; and (2) detecting when the difference between the measured and expected phase difference values returns to a low level indicating the end of the upset event.

18. The method of resetting a time standard assembly according to claim 15, further including the step of periodically instituting the upset recovery steps in order to reset the MDU registers and Z-counter to eliminate the build-up of errors.

* * * * *